US009702246B2

(12) United States Patent
White et al.

(10) Patent No.: US 9,702,246 B2
(45) Date of Patent: Jul. 11, 2017

(54) DOWNHOLE MWD SIGNAL ENHANCEMENT, TRACKING, AND DECODING

(71) Applicant: Scientific Drilling International, Inc., Houston, TX (US)

(72) Inventors: Matthew A. White, Paso Robles, CA (US); Tim Whitacre, Paso Robles, CA (US); Brett Van Steenwyk, Paso Robles, CA (US); Mohamed Youssef, Paso Robles, CA (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 128 days.

(21) Appl. No.: 14/723,414

(22) Filed: May 27, 2015

(65) Prior Publication Data

US 2015/0345287 A1 Dec. 3, 2015

Related U.S. Application Data

(60) Provisional application No. 62/005,843, filed on May 30, 2014, provisional application No. 62/072,805, filed on Oct. 30, 2014.

(51) Int. Cl.
*E21B 47/12* (2012.01)
*E21B 47/18* (2012.01)

(52) U.S. Cl.
CPC ..... *E21B 47/182* (2013.01)

(58) Field of Classification Search
CPC ..... E21B 47/18; E21B 49/008; E21B 47/12; E21B 47/182–47/185
(Continued)

(56) References Cited

U.S. PATENT DOCUMENTS 4,479,564 A 10/1984 Tanguy
7,168,924 B2 1/2007 Beck et al.
(Continued)

FOREIGN PATENT DOCUMENTS

EP 0617196 A2 9/1994

OTHER PUBLICATIONS

D. Alves et al., A real-time algorithm for the harmonic estimation and frequency tracking of dominant components in fusion plasma magnetic diagnostics, REV. SCI. INSTRUM. 84, 083508 (2012).
(Continued)

*Primary Examiner* — Qutbuddin Ghulamali
(74) *Attorney, Agent, or Firm* — Adolph Locklar

(57) ABSTRACT

A method for transmitting data from a MWD system at the BHA of a drill string may include transmitting the data in a MWD signal from the MWD system. The MWD signal may be modulated at a position closer to the surface onto a mud pulse modulated signal. The mud pulse modulated signal may be generated by a downhole friction reducing device. The downhole friction reducing device may include a mud motor. The mud motor may create pressure pulses based on its speed of rotation. The downhole friction reducing device may include a modulating valve. The modulating valve may be electromechanically or mechanically operated. The modulated signal may be detected at the surface by a receiver using one or more pressure or flow sensors. The receiver may use one or more harmonics of the modulated signal to receive the data.

42 Claims, 3 Drawing Sheets

(58) Field of Classification Search
USPC ..... 367/83–84
See application file for complete search history.

(56) References Cited

U.S. PATENT DOCUMENTS

| | | | | |
|---|---|---|---|---|
| 7,673,705 | B2 * | 3/2010 | Gearhart | E21B 47/011 175/40 |
| 8,294,591 | B2 * | 10/2012 | Reed | E21B 47/18 340/855.4 |
| 8,302,685 | B2 | 11/2012 | Reyes et al. | |
| 8,584,747 | B2 | 11/2013 | Eslinger | |
| 8,654,832 | B1 | 2/2014 | Hansen et al. | |
| 8,662,186 | B2 | 3/2014 | Robles | |
| 2012/0001150 | A1 | 1/2012 | Schricker et al. | |
| 2012/0031853 | A1 | 2/2012 | Saphier | |
| 2012/0039151 | A1 * | 2/2012 | Farley | E21B 7/067 367/83 |
| 2012/0146807 | A1 * | 6/2012 | Hutin | E21B 47/182 340/854.5 |
| 2012/0325456 | A1 | 12/2012 | Hill | |
| 2013/0181843 | A1 | 7/2013 | Moghaddamnia et al. | |

OTHER PUBLICATIONS

M. Gupta & B. Santhanam, Adaptive Linear Predictive Frequency Tracking and CPM Demodulation, Signals, Systems and Computers, 2004. Conference Record of the Thirty-Seventh Asilomar Conference on (vol. 1) (2003).

S. Kim et al., Multiharmonic Frequency Tracking Method Using the Sigma-Point Kalman Smoother, Eurasip Journal on Advances in Signal Processing (2010).

P. J. Kootsookos, A review of the Frequency Estimation and Tracking Problems, (1999).

A. Koretz, Maximum A-Posteriori Probability Multiple Pitch Tracking Using the Harmonic Model, Audio, Speech, and Language Processing, IEEE Transactions on (vol. 19, Issue: 7) (2009).

T. Manmek et al., A new efficient algorithm for real time harmonics measurement in power systems, Industrial Electronics Society, 2004. IECON 2004. 30th Annual Conference of IEEE (vol. 2 ) (2004).

S. Quian, Gabor Expansion for Order Tracking, Sound and Vibration (Jun. 2003).

S. Rossignol et al., State-of-the-art in fundamental frequency tracking, Proceedings of Workshop on Current Research Directions in Computer Music, 244-254 (2001).

P. Tichaysky & A. Nehorai, Comparative Study of Four Adaptive Frequency Trackers, Signal Processing, IEEE Transactions on (vol. 45, Issue: 6) (1997).

J. Van Zaen, Efficient Schemes for Adaptive Frequency Tracking and their Relevance for EEG and ECG, (2012).

* cited by examiner

DOWNHOLE MWD SIGNAL ENHANCEMENT, TRACKING, AND DECODING

CROSS-REFERENCE TO RELATED APPLICATIONS

This application is a nonprovisional application which claims priority from U.S. provisional application No. 62/005,843, filed May 30, 2014, and claims priority from U.S. provisional application No. 62/072,805, filed Oct. 30, 2014.

TECHNICAL FIELD/FIELD OF THE DISCLOSURE

The present disclosure relates generally to wireless borehole telemetry systems, and specifically to measurement or logging while drilling telemetry systems used with downhole friction reducing systems.

BACKGROUND OF THE DISCLOSURE

Often in drilling an oil or gas well, drilling fluids, (commonly referred to as "mud") are circulated through the wellbore. The drilling fluids circulate to convey cuttings generated by a drill bit to the surface, drive a down-hole drilling motor, lubricate bearings and a variety of other functions. Wellbore telemetry systems are often provided to transmit information from the bottom of a wellbore to the surface of the earth through the column of drilling fluids in a wellbore. This information might include parameters related to the drilling operation such as down-hole pressures, temperatures, orientations of drilling tools, etc., and/or parameters related to the subterranean rock formations at the bottom of the wellbore such as density, porosity, etc.

Telemetry systems generally include a variety of sensors disposed within a wellbore to collect the desired data. The sensors are in communication with a transmitter adapted to transmit the readings to another location in the wellbore or to the surface. The transmitter may operate by generating a signal using one or more of mud pulses, electric fields, magnetic fields, acoustics, or utilizing wired pipe, also disposed within the wellbore. The mud pulser might, for example be configured to generate patterns of pressure fluctuations in the mud stream that correspond to the sensed data.

SUMMARY

The present disclosure provides for a method for transmitting data from a MWD system to the surface through a wellbore. The method may include generating a MWD signal by the MWD system at a first location in the wellbore. The MWD signal may include at least one datum to be transmitted to the surface. The method may further include modulating the MWD signal onto a pressure pulse carrier signal at a second location in the wellbore. The second location in the wellbore may be located closer to the surface than the first location. The method may also include demodulating the MWD signal from the pressure pulse carrier signal.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
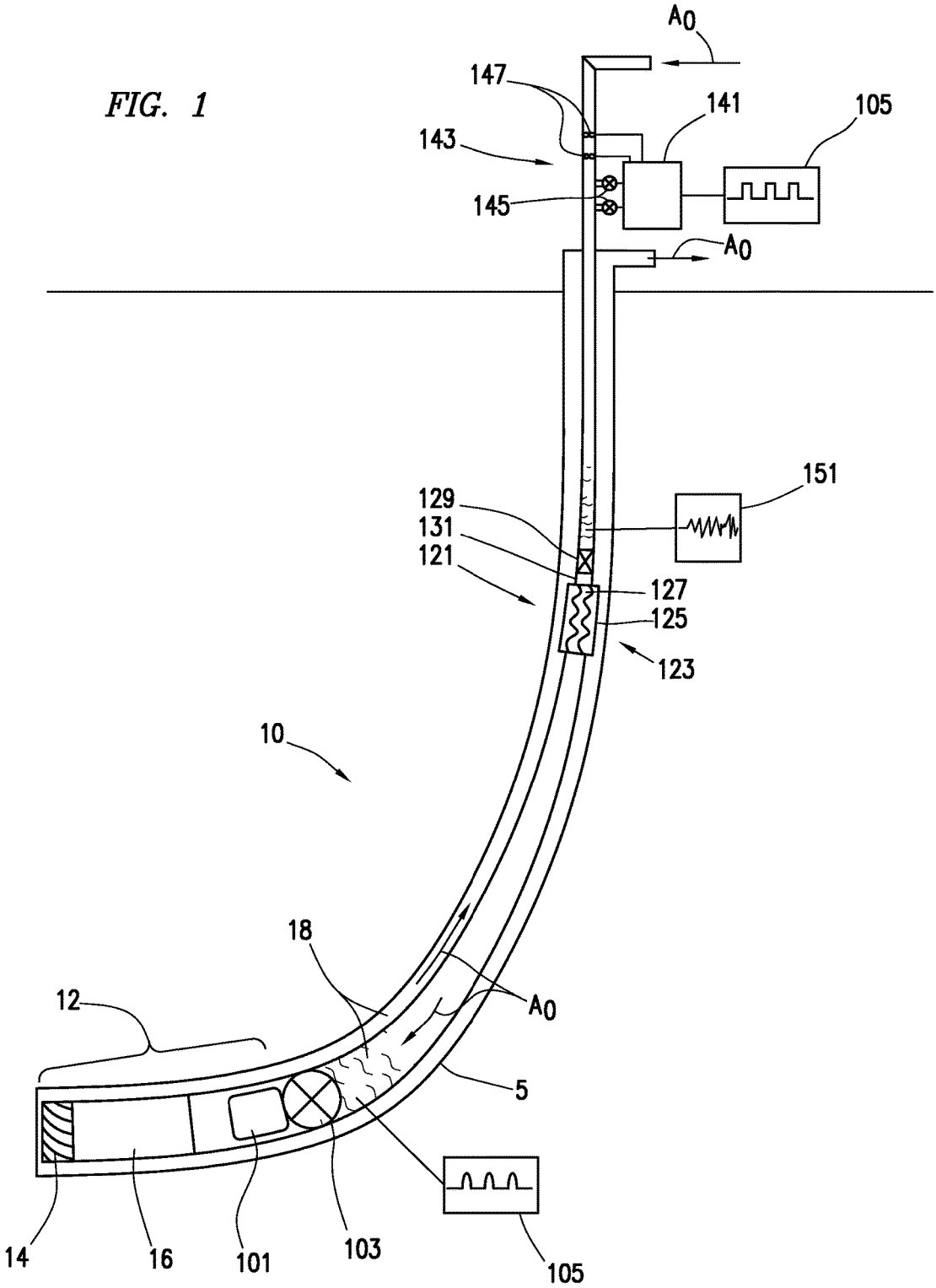
FIG. 1 is a depiction of a drill string in a wellbore consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

In some embodiments of the present disclosure, drill string 10 may be positioned within wellbore 5. Drill string 10 may be made up of a plurality of tubular members adapted to extend into wellbore 5 to, for example drill wellbore 5. In some embodiments, drill string 10 may include bottom hole assembly (BHA) 12. BHA 12 may include, for example and without limitation, drill bit 14, mud motor 16, and measurement while drilling ("MWD") system 101. Drilling operations may generally include the circulation of drilling fluid 18 in wellbore 5 by a mud pump located at the surface in the direction of arrows "$A_0$". Drilling fluid 18 may be passed through the interior of drill string 10 to BHA 12 where drilling fluid 18 may be passed through mud motor 16 to drill bit 14, thereby driving drilling motor 16 and drill bit 14. In some instances, drilling fluid 18 may bypass drilling motor 16 and proceed directly to drill bit 14. Drilling fluid 18 may be discharged through an opening in drill bit 14 and circulated to the surface through the annular space between drill string 10 and wellbore 5. Drilling fluid 18 may, for example and without limitation, serve to lubricate drill bit 14 and carry cuttings away from drill bit 14. In accordance with at least one aspect of the present disclosure, drilling fluid 18 may also serve as a medium through which telemetry message signals may be transmitted, as described in greater detail below.

In some embodiments, MWD system 101 may include one or more sensors. The sensors may include, for example and without limitation, one or more magnetometers, accelerometers, gyros, pressure, gamma, resistivity, sonic, seismic, porosity, density and temperature sensors. As understood in the art, gamma, sonic, resistivity and other LWD or geosteering sensors may be arranged to provide directional sensitivity in one or more directions. Furthermore, as understood in the art, vector sensors such as magnetometers, accelerometers, and gyros may include multiple sensors adapted to measure parameters in more than one axis, including, without limitation, in three orthogonal directions, commonly known as a triaxial arrangement.

In some embodiments, MWD system 101 may further include a processor and associated memory device adapted to gather, receive, store, process, and/or transmit signals from the sensors. In some embodiments, the processor may be adapted to receive and process commands. In some embodiments, MWD system 101 may be able to gather, receive, store, process, and/or transmit, for example and without limitation, one or more of continuous B-total, inclination, RPM, magnetometer data, accelerometer data, temperature, voltage and current data, date/time, and toolface.

In some embodiments, MWD system 101 may include a power source 102 adapted to power one or more of the sensors and processor. In some embodiments, the power source may include, for example and without limitation, one or more batteries or generators. As understood in the art, a generator may be powered by the rotation of a mud motor or a turbine. The power system of MWD system 101 may also include temporary power storage such as one or more capacitor banks or secondary batteries.

In some embodiments, MWD system 101 may include mud pulser 103. MWD system 101 may be in communication with mud pulser 103 by, for example and without limitation, a wired connection, an EM or radio link, a mud-pulse telemetry link or another type of communication link as known in the art. Mud pulser 103 might include a valve adapted to create variations in pressure in the column of drilling fluid 18 to generate a pressure pulse signal defining MWD signal 105 to communicate information gathered by MWD system 101 to receiver 141 which may be positioned at the surface or in the wellbore nearer the surface than MWD system 101. Mud pulser 103 may be adapted to temporarily restrict flow of drilling fluid 18 through drill string 10 to create a positive pressure pulse, open a valve coupling the interior of drill string 10 to the surrounding wellbore to create a negative pressure pulse, or operate by any other means of producing a pressure pulse signal as known in the art. The valve of mud pulser 103 may include, for example and without limitation, a linear piston driven by a pilot valve, a motor driven rotary valve, or other type of mechanism known in the art.

As it propagates up the mud-column to the surface through drill string 10, MWD signal 105 may be attenuated, delayed, and phase shifted and may be corrupted by both down-hole noise sources (such as motor stalls) and up-hole noise sources (such as mud-pump pressure modulations). MWD signal 105 may also be distorted as it travels up the mud-column and is combined with reflections from both down-hole elements (such as the mud-motor, bit, and BHA to drill-string ID changes for example) and up-hole elements (such as the mud-pumps, pulsation dampeners and changes in material or ID of surface piping for example). The combined result of the signal attenuation, noise, and signal distortion may be a reduction in the received signal-to-noise ratio of MWD signal 105, which may result in a reduction in telemetry reliability for such systems when attempting to decode the signal at its original transmission frequency band.

In some embodiments, drill string 10 may further include downhole friction reducing device 121. In some embodiments, downhole friction reducing device 121 may be used to generate lateral, axial, or a combination of lateral and axial vibrations in drill string 10. Downhole friction reducing device 121 may reduce friction so that force is more efficiently transferred to bit 14 from the weight of drill string 10. In some embodiments, downhole friction reducing device 121 may be generally positioned a thousand feet or more back from bit 14 and from mud pulser 103. In some embodiments, downhole friction reducing device 121 may include one or more positive displacement devices used to convert fluid flow to rotational motion of a rotor. For example, in some embodiments, as depicted in FIG. 1, downhole friction reducing device 121 may be powered by mud motor 123. Mud motor 123, as understood in the art, may be a Moineau pump, also known as a progressive cavity pump or progressing cavity pump, and may include stator 125 and rotor 127. The rotation of rotor 127 within stator 125 may be determined by the pressure differential across mud motor 123. Specifically, a higher differential pressure across mud motor 123 may cause rotor 127 to rotate at a higher speed than a slower flow rate of drilling fluid 18. One having ordinary skill in the art with the benefit of this disclosure will understand that although described with respect to a downhole friction reducing device 121, any mud motor 123 in drill string 10 may be utilized as described herein without deviating from the scope of this disclosure.

In some embodiments, rotor 127 may include an eccentric mass or may be attached to a shaft with an eccentric mass resulting in lateral vibration of the drill-string. In some embodiments, rotor 127 may be coupled to modulating valve 129 as discussed herein below, the opening and closing of which may result in a water-hammer effect which induces axial vibration in drill string 10. Downhole friction reducing device 121 may, in some embodiments, impede the direct path for MWD signal 105, which may result in a reduction in amplitude and an increase in noise or attenuation.

In some embodiments, downhole friction reducing device 121 may be powered by the flow of drilling fluid 18 therethrough. One having ordinary skill in the art with the benefit of this disclosure will understand that any system for generating power whether mechanical or electrical may be utilized in downhole friction reducing device 121 without deviating from the scope of this disclosure.

In some embodiments, downhole friction reducing device 121 may generate a carrier signal of pressure pulses, defining modulated signal 151. One having ordinary skill in the art with the benefit of this disclosure will understand that modulated signal 151 may be generated by the standard workings of downhole friction reducing device 121 or by an additional pressure pulse generator as described below. Mud motor 123 may in some embodiments act as a mud pulse signal modulator, modulating MWD signal 105 to the fundamental carrier frequency and harmonic frequencies of modulated signal 151. The amount of frequency and amplitude change of modulated signal 151 as received by receiver 141 may, in some non-limiting embodiments, be from between 0.5 Hz to 25 Hz of the average carrier frequency and within +–30% from the average amplitude. In some embodiments, the carrier frequency of the modulated signal 151 may be selected to be below 50 Hz to, for example and without limitation, reduce propagation attenuation. Modulated signal 151 may then be demodulated by receiver 141 to recover the original MWD signal 105.

In some embodiments, mud motor 123 may generate modulated signal 151. The pulsatile flow through mud motor 123 may, as previously discussed, generate a pressure pulse signal at a frequency proportional to the rotation rate of rotor 127 and the number of lobes in rotor 127. In some embodiments, rotor 127 may be mechanically coupled to additional equipment of downhole friction reducing device 121. In some embodiments, downhole friction reducing device 121 may include modulating valve 129. Modulating valve 129 may be adapted to, for example and without limitation, temporarily and rhythmically at least partially halt the flow of drilling fluid 18 to generate a pressure pulse signal through and vibrate drill string 10 by a "water hammer" effect. In some embodiments, modulating valve 129 may be coupled to rotor 127 directly or through a power transmission system. In such embodiments, the frequency of modulating valve 129 may be proportional to the rotation rate of rotor 127 and the number of lobes in rotor 127, and may thus vary due to differences in flow rate of drilling fluid 18 through mud motor 123. In some embodiments, the pressure pulse signal generated by modulating valve 129 may be utilized as modulated signal 151. In some embodiments, modulating valve 129 may be located below or, as depicted in FIG. 1, above mud motor 123. By locating modulating valve 129 above mud motor 123, the pressure pulse signal generated thereby may be more easily received by receiver 141 as the pressure pulses do not need to travel through mud motor 123.

Figure 2:
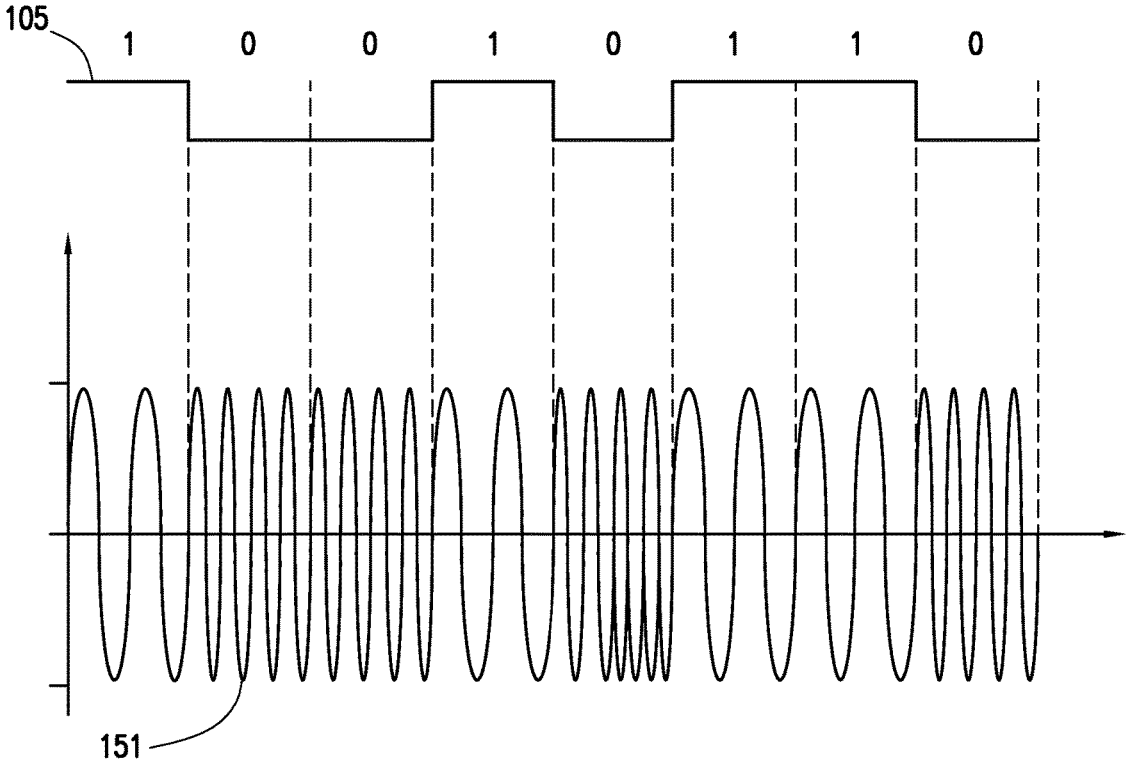
FIG. 2 depicts a MWD signal and modulated signal consistent with at least one embodiment of the present disclosure.

In embodiments wherein modulated signal 151 is generated by mud motor 123 or any other mechanism dependent on the flow rate of drilling fluid 12 therethrough, one having ordinary skill in the art with the benefit of this disclosure will understand that the pressure differential from one end of mud motor 123 to the other will determine the speed at which mud motor 123 is rotated. Thus, the pressure pulses of MWD signal 105 may cause measurable changes in the carrier frequency of modulated signal 151. For example, in an embodiment in which mud pulser 103 generates a negative pressure pulse through the interior of drill string 10, mud motor 123 may increase in speed, thus shifting the carrier frequency of modulated signal 151 to a higher frequency. Similarly, a positive pressure pulse from mud pulser 103 would result in a lower speed for mud motor 123 and a shift to a lower carrier frequency for modulated signal 151. In such an embodiment, the modulation may thus represent frequency shift keying as depicted in FIG. 2. Because downhole friction reducing device 121 may be located nearer to the surface than mud pulser 103, the modulated signal may suffer a smaller amount of propagation attenuation due to the reduced distance of travel within wellbore 5. In some embodiments, mud pulser 103 may generate a continuous wave instead of pressure pulse which may cause a regular speed variation in mud motor 123.

One having ordinary skill in the art with the benefit of this disclosure will understand that any other system for generating modulated signal 151 may be utilized and need not be driven by a mud motor. For example, modulating valve 129 may, in some embodiments, be driven directly by the motion of rotor 127 through a gearbox or other coupling mechanism, through an electric or other hydraulic motor, solenoid, or other electro-mechanical device powered by, for example and without limitation, a battery or generator. In some embodiments, a generator (not shown) may be powered by rotation of mud motor 123. In some embodiments, the speed of rotation of mud motor 123 may be controlled by, for example and without limitation, connecting one or more stages of a connected generator's coils at the desired modulation frequency for modulated signal 151 so that the torque load on rotor 127 is accordingly modulated.

In some embodiments, the carrier frequency range of modulated signal 151 may be selected to correspond to an optimum signal band for telemetry, where, for example, any noise in wellbore 5 is lower in amplitude than modulated signal 151. Additionally, the carrier frequency range of modulated signal 151 may be adaptively selected such that the attenuating and distorting effects of the channel due to propagation attenuation and reflections are reduced. In embodiments utilizing a mechanical connection between modulating valve 129 and mud motor 123, the mechanical linkage, including any gears, may be selected such that the anticipated flow rate of drilling fluid 12 will result in modulated signal 151 being generated at or near the optimal frequency range.

In embodiments in which modulating valve 129 is electromechanically actuated, modulating valve 129 may be driven at or near the optimum fundamental frequency. In some embodiments, modulating valve 129 may be controlled by modulator controller 131. In some embodiments, modulator controller 131 may detect MWD signal 105 and actively modulate modulating valve 129. In some embodiments, modulator controller 131 may modulate modulating valve 129 in response to detected changes in speed of mud motor 123 caused by MWD signal 105. In some embodiments, modulator controller 131 may include a pressure sensor adapted to receive MWD signal 105 from mud pulser 103. Modulator controller 131 may modulate modulating valve 129 in response to the received MWD signal 105. In some embodiments, MWD system 101 may transmit MWD signal 105 at a higher frequency than modulated signal 151. For example, in some embodiments, MWD signal 105 may be transmitted at 15 Hz to 150 Hz. One having ordinary skill in the art with the benefit of this disclosure will understand that although a high-frequency signal may be more prone to attenuation, utilizing a higher frequency for MWD signal 105 may, for example and without limitation, increase bandwidth and/or reduce in-band noise energy, for communication between MWD system 101 and downhole friction reducing device 121. Downhole friction reducing device 121 may modulate MWD signal 105 onto a lower frequency modulated signal 151 for communication to the surface or a location in the wellbore nearer to the surface than MWD system 101.

Although described above with respect to downhole friction reducing device 121, as utilizing mud motor 123 of downhole friction reducing device 121, any mud motor 123 in drill string 10 may be used to generate modulated signal 151 for communication to the surface or a location in the wellbore nearer the surface as described hereinabove. For example, in some embodiments, mud motor 16 located below MWD system 101 of BHA 12 may be utilized as described above to generate modulated signal 151.

In some embodiments, MWD system 101 may transmit information by a medium other than mud pulse telemetry. For example, MWD system 101 may transmit MWD signal 105 by, for example and without limitation, electric field, magnetic field, acoustic, or wired pipe connectivity. In some embodiments, for example, modulator controller 131 may include a receiver such as, for example and without limitation, an insulating gap or toroidal antenna around a collar to sense an electric field MWD signal 105. In some embodiments, a coil around the collar or magnetometer could be used to sense a magnetic field MWD signal 105.

Modulator controller 131 may modulate data from MWD signal 105 according to any modulation so as to best utilize the bandwidth available and make the signal as unique from the noise within the band as possible. For example, the modulation scheme may include without limitation frequency shift key, phase shift key, amplitude modulation, quadrature amplitude modulation, minimum shift key, and chirp modulation. Additionally, orthogonal frequency division multiplexing (OFDM) and spread spectrum techniques such as, for example, direct sequence spread spectrum (DSSS), frequency hopping spread spectrum (FHSS), time hopping spread spectrum (THSS) and chirp spread spectrum (CSS) may be used to spread the spectrum of the signal. As understood in the art, the modulation may be performed as a regenerative or non-regenerative operation. In embodiments utilizing a regenerative operation, MWD signal 105 as received by modulator controller 131 may be first decoded so that the modulated signal is generated in accordance with the decoded data stream, eliminating any noise in the received MWD signal 105. In embodiments utilizing a non-regenerative operation, MWD signal 105 as received by modulator controller 131 may be modulated without decoding so that the modulated signal contains both the MWD signal 105 as received by modulator controller 131 as well as any noise generated during the drilling process.

In some embodiments, multiple downhole friction reducing devices 121 may be included at multiple locations along drill string 10. Multiple downhole friction reducing devices 121 may be used, for example and without limitation, when drilling long laterals. In such an embodiment, each downhole friction reducing device 121 may be operated at a unique and sufficiently separated fundamental frequency. In such an embodiment, MWD signal 105 may be relayed between adjacent downhole friction reducing devices 121 until the surface is reached. By keeping each downhole friction reducing device 121 on a separate frequency, any interference between modulated signals may be avoided. For example, in an embodiment utilizing one or more mud motors 123 without modulator valves 129, the number of lobes on the rotor may be varied between downhole friction reducing devices 121 such that each rotates at a different rate for a given flow rate of drilling fluid 18. In an embodiment utilizing two or more mechanically driven modulator valves 129, each modulator valve may be coupled to its respective rotor 127 by a gearbox having different drive ratio to separate their frequencies. In embodiments utilizing electrically driven modulator valves 129, each respective modulator valve controller 131 may be programmed to have a different fundamental frequency. As understood in the art, multiple modulator valves 129 may be utilized to, for example and without limitation, allow for higher pressure with less wash on components due to splitting pressure across the multiple modulator valves 129.

In some embodiments utilizing multiple downhole friction reducing devices 121, code division multiple access (CDMA) on the same carrier frequency may be utilized. In such an embodiment, the modulated signal from each downhole friction reducing device 121 may be modulated by a code as well as MWD signal 105. In some embodiments, the codes used at each downhole friction reducing device 121 may be substantially orthogonal to the codes of the other downhole friction reducing devices 121 such that receiver 141 may be able to separate the signals out at surface even though they occupy the same frequency band.

In some embodiments, downhole friction reducing device 121 may include one or more sensors. In some embodiments, the data received by the one or more sensors may be included in the modulated signal transmitted from the downhole friction reducing device 121.

In some embodiments, receiver 141 may be located at the surface and adapted to detect the modulated pressure signal generated by the one or more downhole friction reducing devices 121 and/or modulator valves 129. In some embodiments, receiver 141 may include one or more receiver sensors 143. In some embodiments, receiver sensors 143 may include one or more pressure sensors 145 and/or one or more flow sensors 147. In some embodiments, pressure sensors 145 and flow sensors 147 may be utilized to detect, for example, local change in flow due to passing pressure waves from the modulated pressure signal. In some embodiments, pump stroke rate sensors (not shown) may be utilized as a reference signal for cancelling pump generated pressure and flow fluctuations from the signals received from pressure sensors 145 and/or flow sensors 147. In some embodiments, the pump stroke rate may be used to indicate to the operator when pump noise is expected to interfere with modulated signal 151. Additionally, in some embodiments, one or more sensors adapted to detect MWD signal 105 as transmitted by MWD system 101 may also be used. For example, receiver sensors 143 may simultaneously be used to detect a mud pulse MWD signal 105. Likewise, ground stakes, antennae, coils, or magnetometers may be used to detect an electric or magnetic MWD signal 105. In some embodiments, accelerometers located on a top drive may be utilized to detect an acoustic MWD signal 105. One having ordinary skill in the art with the benefit of this disclosure will understand that any known telemetry methods may be utilized within the scope of this disclosure.

Receiver 141 may further include a signal processing and decoding system connected to receiver sensors 143 which may be used to demodulate and decode the modulated signal to recover the original MWD signal 105. Additionally, the carrier frequency of modulated signal 151 may vary based on changes in flow rate for drilling fluid 18 during the course of a downhole operation. In some embodiments, receiver 141 may adaptively track the carrier frequency of modulated signal 151 in order to demodulate and recover MWD signal 105. For example and without limitation, in some embodiments, the signal processing and decoding system may utilize a peak detector on selected bands from successive applications of a windowed short term Fourier transform. In such an embodiment, a short segment of the data from receiver sensors 143 may be multiplied by a window function to, for example, reduce bias in the resultant spectral estimate. The short segment may be sized from 1-4 times the width of the fundamental pulse width of MWD signal 105. In some embodiments, a hamming function, Kaiser window, or Chebyshev window may be utilized. After applying the window function to the data received from receiver sensors 143, a Fourier Transform may be performed on the data using a Fast Fourier Transform (FFT) or other method of obtaining the signal spectra. The peak magnitude of FFT output over the range of desired frequencies may then be determined. The process may then be repeated starting with the application of the window function on subsequent segments of receiver sensor 143 data to produce a time sequence indicating the frequency containing the maximum signal energy over the limited range of desired frequencies processed, thus demodulating MWD signal 105 from the modulated pressure signal. One having ordinary skill in the art with the benefit of this disclosure will understand that demodulation of modulated signal 151 could alternatively be implemented by one of several known time domain techniques which include, without limitation, coherent or non-coherent frequency, phase and amplitude demodulation methods.

In some embodiments, the selected bands used by the signal processing and decoding system of receiver 141 may be determined by the operator and entered into the system manually. In such embodiments, and without limitation, a visual display may be provided to assist the operator in determining the optimum frequency bands to use in demodulating the modulated signal 151. In some embodiments, automatic determination of the carrier frequency of modulated signal 151 may be accomplished by using flow rate measured by flow rate sensor 147 or the flow rate determined from pump stroke rate sensors (not shown) and the known relationship between flow rate and modulation frequency of downhole friction reducing device 121. In such embodiments, the selected bands used by the signal processing and decoding system of receiver 141 may be centered about the determined carrier frequency of modulated signal 151 and include a bandwidth sufficient to encompass the full carrier frequency deviation of modulated signal 151. In some embodiments, the bandwidth of modulated signal 151 may be determined by the operator. In such embodiments, the operator may use, for example and without limitation, a spectrogram display to determine the bandwidth of modulated signal 151.

Figure 3:
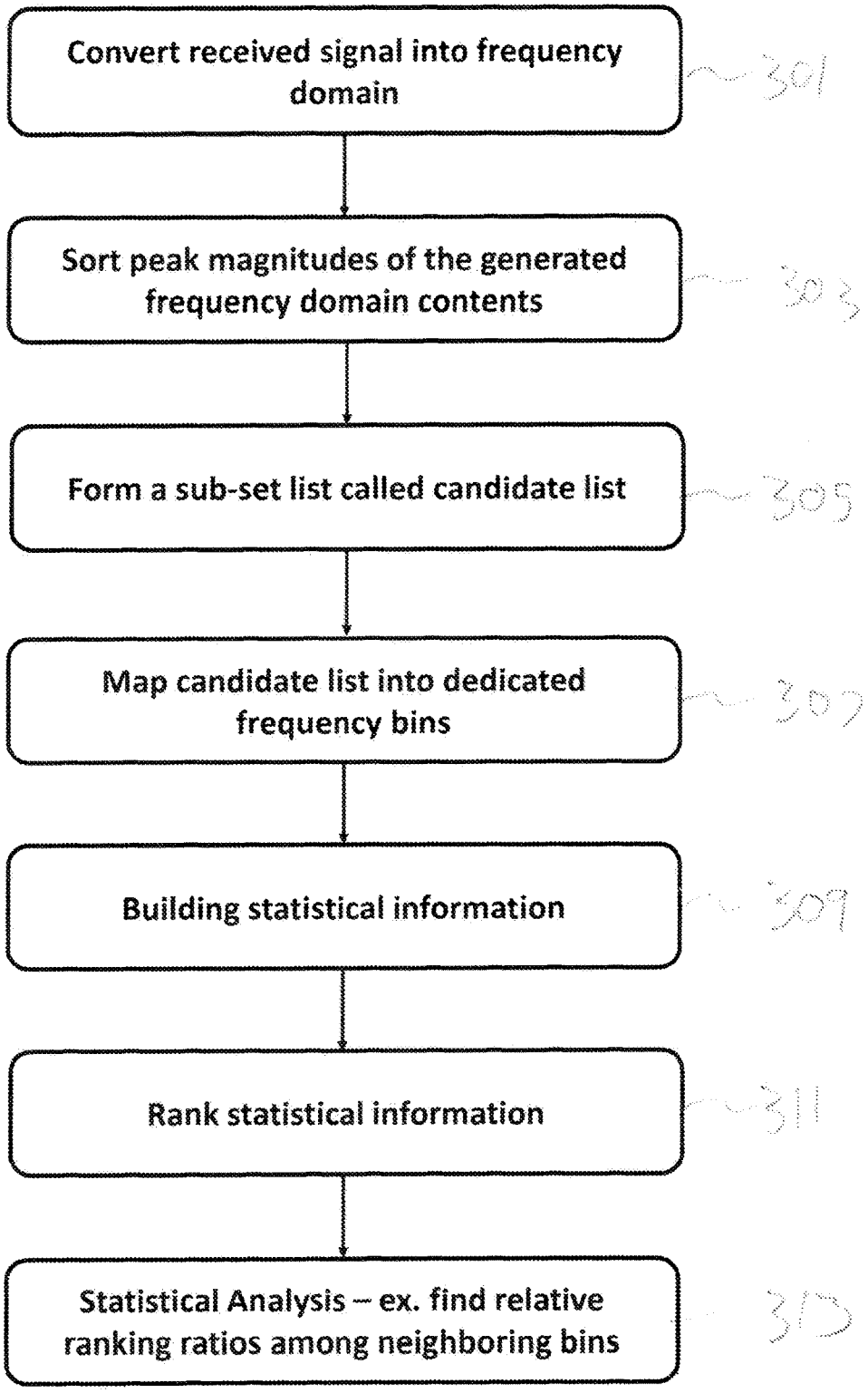
FIG. 3 is a flow chart depicting a signal processing and decoding operation consistent with at least one embodiment of the present disclosure.

In some embodiments, the selected bands used by the signal processing and decoding system of receiver 141 and the carrier frequency deviation of modulated signal 151 may be automatically and adaptively determined by use of a statistical learning algorithm. The statistical learning algorithm may be used to build a frequency monitoring system (not shown). This monitoring system may be responsible for mapping and ranking the frequency activities among a range of monitored frequencies over a period of time. The ranking criteria may then be used to track the carrier frequency and the bandwidth of the modulated signal 151. In some embodiments the frequency monitoring system may allow automatic determination of interference signals such as, for example, pump noise. In such embodiments, the frequency monitoring system may alert the operator and suggest changing the pump rate to move the interference signal away from the carrier frequency of modulated signal 151. As an example, FIG. 3 depicts a flow chart of an embodiment of the present disclosure as previously described. Modulated signal 151 as received may be converted into the frequency domain (301) by, for example, a windowed FFT operation. Detected peak magnitudes generated from the frequency domain data may be sorted (303) according to the respective frequency band. A subset of frequency bands may be identified in a candidate list (305) of frequency bands. The candidate list may then be mapped into dedicated frequency bins (307). As previously discussed, statistical information used to track carrier frequency and bandwidth of modulated signal 151 may be built (309) based on the frequency domain data. The statistical information may be ranked (311), and statistical analysis may be undertaken (313) as described below.

For example and without limitation, in some embodiments, the frequency monitoring system may utilize successive applications of a windowed FFT to build statistical information used to track carrier frequency and bandwidth of modulated signal 151 adaptively. In such an embodiment, frequency could be broken into coarse frequency bins of, for example 0.5 Hz, and a corresponding score assigned to each bin. For each successive FFT, the score could be increased if the FFT peak magnitude over the corresponding frequency range was above a pre-determined energy level. If the FFT peak magnitude for the corresponding frequency range was not above the pre-determined energy level, the score could be decreased. The pre-determined energy level could be, for example and without limitation, the energy level corresponding to the top 5% of energies calculated by the FFT for the current iteration. In some embodiments, the increase and decrease rates need not be the same but could, for example, be setup such that decreasing the score would occur at a faster rate than increasing the score. In this way, the scores represent the statistical information of energy vs frequency with a memory time constant dictated by the ratio between the increase and decrease rates for the scores. As a nonlimiting example, the scores could, for example, be increased by 1 when the energy levels from the FFT corresponding to the associated frequency bin are above the pre-determined energy level and decreased by 0.1 when below so that the increase rate is 10 times the decrease rate. The statistical information may then be ranked by, for example and without limitation, sorting the scores in descending order. The scores might also be used in conjunction with the known duty cycle and statistical distribution of MWD signal 105 as well as the observed or known response of friction reducing device 121 to classify bands as signal bands or interference bands. As an example, to classify the band as a signal band rather than an interference band, the score for the center frequency may be required to be greater than 50 while the score for the adjacent frequency bin directly above the center frequency may be required to be above 20 and the score for the adjacent frequency bin directly below the center frequency may be required to be above 30. The scores might also be used to automatically and adaptively determine the bandwidth of the signal band by, for example, determining the upper and lower frequencies where the associated frequency bin score drops below a pre-determined value. The pre-determined value used to determine the upper and lower frequencies defining the bandwidth of the signal could, for example, be 7.

One having ordinary skill in the art with the benefit of this disclosure will understand that the adaptive tracking of the carrier frequency of modulated signal 151 may be accomplished in a number of ways. For example and without limitation, one having ordinary skill in the art with the benefit of this disclosure will understand that embodiments of the present disclosure may utilize such methods as described in D. Alves et al., *A real-time algorithm for the harmonic estimation and frequency tracking of dominant components in fusion plasma magnetic diagnostics*, Rev. Sci. Instrum. 84, 083508 (2012); M. Gupta & B. Santhanam, *Adaptive Linear Predictive Frequency Tracking and CPM Demodulation*, Signals, Systems and Computers, 2004. Conference Record of the Thirty-Seventh Asilomar Conference on (Volume: 1) (2003); S. Kim et al., *Multiharmonic Frequency Tracking Method Using the Sigma-Point Kalman Smoother*, EURASIP Journal on Advances in Signal Processing (2010); P. J. Kootsookos, *A review of the Frequency Estimation and Tracking Problems*, (1999); A. Koretz, *Maximum A-Posteriori Probability Multiple Pitch Tracking Using the Harmonic Model*, Audio, Speech, and Language Processing, IEEE Transactions on(Volume: 19, Issue: 7) (2009); T. Manmek et al., *A new efficient algorithm for real time harmonics measurement in power systems*, Industrial Electronics Society, 2004. IECON 2004. 30th Annual Conference of IEEE (Volume:2) (2004); S. Qian, *Gabor Expansion for Order Tracking*, Instrumentation and Measurement, IEEE Transactions on (Volume: 52, Issue: 3) (2003); S. Rossignol et al., *State-of-the-art in fundamental frequency tracking*, Proceedings of Workshop on CurrentResearch Directions in Computer Music, 244-254 (2001); P. Tichaysky & A. Nehorai, *Comparative Study of Four Adaptive Frequency Trackers*, Signal Processing, IEEE Transactions on (Volume: 45, Issue: 6) (1997); J. Van Zaen, *Efficient Schemes for Adaptive Frequency Tracking and their Relevance for EEG and ECG*, (2012), the entirety of each being hereby incorporated by reference.

In some embodiments, modulated signal 151 may not be purely sinusoidal due to, for example and without limitation, the generation mechanism for modulated signal 151. Thus, the modulated pressure signal may include multiple frequencies in addition to the fundamental frequency. In some embodiments, there may be a harmonic or sub-harmonic relationship between the multiple frequencies. In some such embodiments, receiver 141 may utilize a multi-frequency tracking and demodulation algorithm. Receiver 141 may thus receive and demodulate one or more frequencies in addition to the fundamental frequency of the modulated pressure signal. The data received on each frequency band may be weighted according to their estimated signal to noise ratios in the final output or in a multi-input decision feedback algorithm operating either on the demodulated signal or directly on the modulated signals. In some embodiments, because the quality of MWD signal 105 varies over time, a received filtered MWD signal could also be weighted into the final output according to a pre-determined metric, for example and without limitation, its estimated signal to noise ratio or considered in a multi-input decision feedback mechanism.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method for transmitting data from a measurement while drilling ("MWD") system to the surface through a wellbore comprising:

generating a MWD signal by the MWD system at a first location in the wellbore, the MWD signal including at least one datum to be transmitted to the surface, the MWD signal transmitted in a first frequency range;

modulating the MWD signal onto a pressure pulse modulated signal at a second location in the wellbore, the second location in the wellbore located closer to the surface than the first location, the pressure pulse modulated signal transmitted in a second frequency range;

receiving the pressure pulse modulated signal at the surface by a receiver, the receiver including at least one sensor adapted to detect pressure pulses; and decoding the MWD signal from the pressure pulse modulated signal by:

comparing the signal to noise ratio of a second fundamental frequency of the second frequency range to the signal to noise ratio of one or more harmonics of the second fundamental frequency; and decoding the MWD signal from the signal at the second fundamental frequency, the one or more harmonics of the second fundamental frequency, or a combination thereof.

2. The method of claim 1, further comprising:

positioning a mud motor at the second location, the mud motor adapted to modulate the MWD signal on to the pressure pulse modulated signal.

3. The method of claim 2, wherein the mud motor is a part of a downhole friction reducing device.

4. The method of claim 2, wherein the MWD system generates the MWD signal using a mud pulser.

5. The method of claim 4, wherein the mud pulser is adapted to produce a positive pressure pulse, such that the mud pump decreases in speed during a pressure pulse of the MWD signal.

6. The method of claim 4, wherein the mud pulser is adapted to produce a negative pressure pulse, such that the mud pump increases in speed during a pressure pulse of the MWD signal.

7. The method of claim 4, wherein the mud pulser is adapted to produce a continuous pressure wave, such that the mud pump changes speed during a pressure pulse of the MWD signal.

8. The method of claim 2, wherein the mud motor is coupled to at least one modulator valve, the modulator valve adapted to at least partially halt or restrict the flow of drilling fluid through the modulator valve to generate a pressure pulse.

9. The method of claim 8, wherein the modulator valve is operatively coupled to a mud motor and adapted to open and close at a rate proportional to the rotation rate of the mud motor.

10. The method of claim 9, wherein the modulator valve is coupled to the mud motor through a gearbox.

11. The method of claim 8, wherein the modulator valve is operated electromechanically.

12. The method of claim 11, wherein the modulator valve is operated by a solenoid, electric motor, or actuator.

13. The method of claim 11, wherein the modulator valve is powered by one or more batteries or generators.

14. The method of claim 13, wherein at least one generator is at least partially powered by rotation of a mud motor or a turbine.

15. The method of claim 14, wherein the generator is adapted to modulate the speed of rotation of the mud motor by modulating the torque load on the mud motor.

16. The method of claim 1, wherein the MWD system generates the MWD signal using at least one of a mud pulse telemetry link, wired connection, electromagnetic, or radio link.

17. The method of claim 1, wherein the MWD signal is transmitted in a first frequency range and the pressure pulse modulated signal is transmitted in a second frequency range.

18. The method of claim 17, wherein the second frequency range is higher or lower than the first frequency range.

19. The method of claim 17, wherein the second frequency range comprises a fundamental frequency and harmonics thereof.

20. The method of claim 1, wherein the MWD signal is modulated onto the pressure pulse modulated signal by one of frequency shift key, phase shift key, amplitude modulation, quadrature amplitude modulation, minimum shift key, chirp modulation, orthogonal frequency division multiplexing (OFDM), direct sequence spread spectrum (DSSS), frequency hopping spread spectrum (FHSS), time hopping spread spectrum (THSS), chirp spread spectrum (CSS) or a combination thereof.

21. The method of claim 1, further comprising:

receiving the MWD signal at the second location;

decoding the MWD signal;

re-encoding the at least one datum into a second MWD signal; and modulating the second MWD signal onto the pressure pulse modulated signal.

22. The method of claim 1, further comprising:

modulating the pressure pulse modulated signal onto a second pressure pulse modulated signal at a third location in the wellbore, the third location in the wellbore located closer to the surface than the second location, the second pressure pulse modulated signal having a third frequency range;

decoding the MWD signal from the second pressure pulse modulated signal.

23. The method of claim 1, wherein the sensor comprises a pressure sensor or flow sensor.

24. The method of claim 1, wherein the receiver comprises at least one sensor adapted to detect the MWD signal.

25. The method of claim 24, wherein the received MWD signal and received pressure pulse modulated signal may both be used to decode the at least one datum.

26. The method of claim 24, wherein the sensor adapted to detect the MWD signal comprises a pressure sensor, flow sensor, ground stake, antenna, coil, magnetometer, or accelerometer.

27. The method of claim 1, further comprising actively tracking the frequency of the pressure pulse modulated signal corresponding to a second fundamental frequency with the receiver, as the second fundamental frequency varies during a drilling operation.

28. The method of claim 27, wherein the decoding operation further comprises:

sampling a segment of the received pressure pulse modulated signal, the length of the segment being generally short;

applying a window function to the segment;

calculating the frequency spectrum of the segment;

detecting the frequency having the peak magnitude of the frequency spectrum of the segment, the frequency having the peak magnitude generally corresponding to the frequency having the greatest signal energy over the range of desired frequencies; and repeating the above operations for subsequent segments.

29. The method of claim 28, wherein the length of the segment is selected to be generally 1-4 times the fundamental pulse width of the MWD signal.

30. The method of claim 28, further comprising:

tracking the frequency having the peak magnitude at each time; and decoding the MWD signal from the tracked frequencies having the peak magnitude at each time.

31. The method of claim 28, wherein the window function is one of a hamming function, Kaiser window, or Chebyshev window.

32. The method of claim 28, wherein the frequency spectrum is generated using a Fourier Transform or a Fast Fourier Transform.

33. The method of claim 27, further comprising displaying a spectrogram display of the modulated signal and manually selecting a signal band by an operator.

34. The method of claim 27, further comprising:

measuring flow rate by one or more of a flow rate sensor or a pump stroke rate sensor; and determining the frequency band based at least partially on a known relationship between flow rate and modulation frequency of the mud motor.

35. The method of claim 27, the actively tracking operation comprises:

converting the pressure pulse modulated signal as received into the frequency domain;

sorting peak magnitudes of the generated frequency domain contents;

forming a sub-set list of frequency bands defining a candidate list;

mapping the candidate list into dedicated frequency bins;

building statistical information used to track carrier frequency;

ranking the statistical information; and undertaking a statistical analysis to find relative ranking ratios among neighboring frequency bins.

36. The method of claim 35, wherein the frequency bins of the mapping operation are separated by approximately 0.5Hz.

37. The method of claim 35, wherein the building statistical information operation comprises assigning a score to each frequency bin.

38. The method of claim 37, wherein the building statistical information operation further comprises, for each frequency bin, increasing the score of the frequency bin if the peak magnitude of the generated frequency domain content is above a pre-determined energy level or decreasing the score if the peak magnitude of the generated frequency domain content is below the pre-determined energy level.

39. The method of claim 38, wherein the pre-determined energy level corresponds with the top 5% of peak magnitude of the peak magnitudes.

40. The method of claim 37, wherein the statistical analysis comprises classifying a frequency band corresponding with a frequency bin as a signal or an interference band.

41. The method of claim 40, wherein the frequency band is classified as a signal or interference band based at least partially on the score assigned to the frequency bin.

42. The method of claim 41, wherein the frequency band is classified as a signal or interference band based at least partially on the score assigned to a neighboring frequency bn.

* * * * *